United States Patent [19]

Okada

[11] 4,281,458

[45] Aug. 4, 1981

[54] COMPACT SAFETY KNIFE

[75] Inventor: Yoshio Okada, Osaka, Japan

[73] Assignee: Okada Kogyo Kabushiki Kaisha, Osaka, Japan

[21] Appl. No.: 67,762

[22] Filed: Aug. 17, 1979

[30] Foreign Application Priority Data

Dec. 27, 1978 [JP] Japan ..... 53-179111[U]
Feb. 22, 1979 [JP] Japan ..... 54-22721[U]

[51] Int. Cl.[3] ..... B26B 1/00
[52] U.S. Cl. ..... 30/162; 30/293
[58] Field of Search ..... 30/162, 294, 320, 2

[56] References Cited

U.S. PATENT DOCUMENTS 2,550,346 4/1951 Gregg ..... 30/162 X
3,068,569 12/1962 Campbell ..... 30/294
3,999,290 12/1976 Wood ..... 30/162 X
4,139,939 2/1979 Crooks ..... 30/162 X

*Primary Examiner*—Jimmy C. Peters
*Attorney, Agent, or Firm*—Wenderoth, Lind & Ponack

[57] ABSTRACT

A handy safety knife comprises a generally flat holder having a chamber and an opening both defined therein, an elongated blade member, a manipulatable member carried by the holder for movement between projected and retracted position and operatively coupled to the blade member, a spring element for biasing the manipulatable member to the retracted position to hold the blade member in position to be concealed within the chamber, and, if desired, a wedge member for retaining the manipulatable member in the projected position once it has been moved thereto.

6 Claims, 8 Drawing Figures

COMPACT SAFETY KNIFE

BACKGROUND OF THE INVENTION

The present invention generally relates to a compact safety knife suited for use in paper cutting, pencil sharpening and like handicraft work and, more particularly, to a handy safety knife of a type having a knife blade automatically concealable when not in use.

Various knives are well known and currently commerically available. So far as the capability of the knife blade being concealed within the holer is involved, there is well known a safety knife of a type which comprises an elongated holder having a guide groove of a cross section similar in shape to a substantially flattened figure "C", an elongated blade member inserted in the guide groove for movement in a direction lengthwise of the blade member, and a manipulatable member having a portion exposed outside the holder through an axially extending slit in the holder and another portion coupled to the blade member. In this conventional safety knife, by applying an external force to the manipulatable member in a direction lengthwise of the blade member, the blade member can be selectively projected from and retracted into the guide groove in the holder. While the continued application of the external force is required to maintain the blade member in a position projected outwards from the holder when in use, an elastic tongue is integrally formed with the other portion of the manipulatable member and is frictionally engaged to a wall defining the guide groove such that, when the blade member is retracted into the guide groove, it can be held in the retracted position.

The conventional safety knife of the above described construction is satisfactory in many respects, but it has some disadvantages. One of them is the possibility that, when the safety knife is accidentally shaken with the opening of the guide groove pointed outwards, the blade member in the retracted position will project outwards through the opening of the guide groove. Therefore, the user of the conventional safety knife is exposed to dangers when the blade member is exposed outside of the holder in the manner described above. Although increased friction between the elastic tongue and the wall defining the guide groove may avoid this possibility, this brings about the adverse effect of requiring the application of a correspondingly increased external force for moving the blade member between the projected and retracted positions.

Another disadvantage is that, since the blade member is constituted by a razor blade which is specially designed for use in shaving, not only is the conventional safety knife bulky in size, but it also does not have a very good appearance.

A further disadvantage is that, since the conventional safety knife including the holder is made of a metallic material, not only is the manufacture thereof complicated, but also it requires a relatively high manufacturing cost. Although synthetic resin can be used as a material for the holder, the life of the knife would be reduced or the magnitude of friction required to be developed between the elastic tongue and the wall defining the guide groove would be reduced, because of the frictional wear of that portion of the holder which is held in contact with the elastic tongue.

SUMMARY OF THE INVENTION

The present invention has been developed for substantially eliminating the above described disadvantages inherent in the conventional safety knife and has for its essential object to provide an improved handy safety knife of a type having a knife blade which can automatically be concealed within the holder when not in use.

Another important object of the present invention is to provide an improved handy safety knife of the type referred to above, which has a handsome appearance.

A further object of the present invention is to provide an improved handy safety knife of the type referred to above, which can be used not only as a knife itself, but also as an accessory of, for example, a keyholder.

A still further object of the present invention is to provide an improved handy safety knife of the type referred to above, which is easy to handle.

A still further object of the present invention is to provide an improved handy safety knife of the type referred to above, which is inexpensive and can, therefore, be a throw-away article.

In order to accomplish these and other objects of the present invention, the present invention provides an improved handy safety knife which comprises a generally flat holder having a chamber and an opening therein, an elongated blade member, a manipulatable element carried by the holder for movement between projected and retracted positions and operatively coupled to the blade member, means for biasing the manipulatable element to the retracted position to hold the blade member in position to be concealed within the chamber, and means for guiding the blade member in a longitudinal, straight direction during the movement of the manipulatable element between the projected and retracted positions.

The opening in the holder is between the chamber and the outside of the holder for the passage of the blade member therethrough during the movement of the manipulatable element. The improved handy safety knife of the present invention is so designed that, when the manipulatable element is held in the projected position, only one end portion of the blade member projects outwards from the chamber through the opening and to the outside of the holder and, when the manipulatable element is held in the retracted position, the blade member is concealed within the chamber. Because the movement of the manipulatable element from the projected position to the retracted position is automatically effected by the action of the biasing means which may be constituted by a spring element such as a leaf spring, a wire spring, a compression spring or a tension spring, the movement of the manipulatable element from the retracted position to the projected position can be effected by the application of an external force acting in a direction lengthwise of the blade member and against the biasing means.

The holder is constituted by generally plate-like, first and second holder segments joined together with the chamber defined therebetween. In one preferred embodiment, the first and second holder segments are separate from each other. In this case, the joining of the first and second holder segments can be achieved by the use of any suitable bonding agent and/or by the use of a pin-and-socket arrangement wherein a plurality of pins formed on either the first or second holder segments are tightly inserted into corresponding sockets formed on the other of the first and second holder segments.

In another preferred embodiment of the present invention, the first and second holder segments are integrally connected to each other and the complete holder can be assembled by folding either the first or second holder segments relative to the other of the first and second holder segments. In order to avoid any possible opening of either one of the first and second holder segments relative to the other of the first and second holder segments, a bonding agent and/or a similar pin-and-socket arrangement may be employed. In particular, where holder is made up of the integrally connected first and second holder segments, it must be made of a synthetic resin which may be polyethylene, polypropylene or polyvinyl chloride.

The handy safety knife according to the present invention may further comprise means for retaining the manipulatable element in the projected position once it has been moved thereto. This retaining means may comprise a wedge member integrally formed on the holder at a location on the path of movement of the manipulatable element so that, when the manipulatable element is moved to the projected position, it can override the wedge member to exert a frictional force necessary to retain the manipulatable element in the projected position and overcoming the biasing force of the biasing means tending to move the manipulatable element towards the retracted position. The frictional force so developed to retain the manipulatable element in the projected position can readily be cancelled merely by applying an external force to the manipulatable element to move the latter towards the retracted position.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Figure 1:
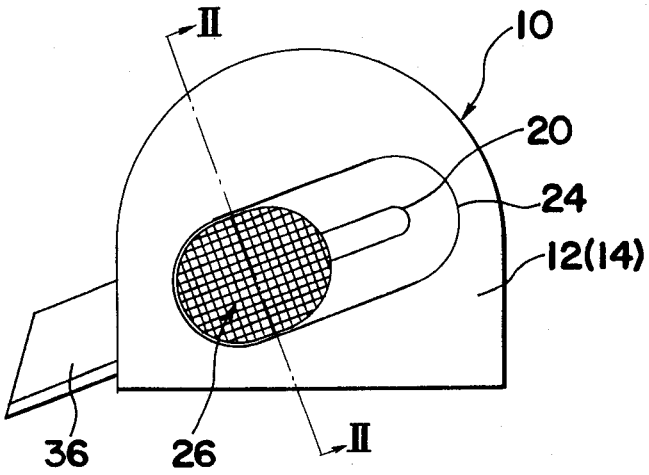
FIG. 1 is a side elevational view of a handy safety knife according to a first preferred embodiment of the present invention.

Before the description of the present invention proceeds, it is to be noted that like parts are designated by like reference numerals throughout the accompanying drawings.

Referring first to FIGS. 1 to 4, a handy safety knife according to a first preferred embodiment of the present invention comprised a generally flat box-like holder 10 including substantially plate-like, first and second holder segments 12 and 14 of similar configuration. The holder 10 may be of any desired shape, for example, rectangular, polygonal or circular shape or of any other shape generally considered suited or appropriate to make the handy safety knife of the present invention usable as a pocket item or an accessory to a keyholder. However, as presently illustrated, the holder 10 has a generally semi-circular shape selected so that it can be held comfortably and steadily during the use of the handy safety knife. Preferably, the holder 10 is hand size.

Figure 2:
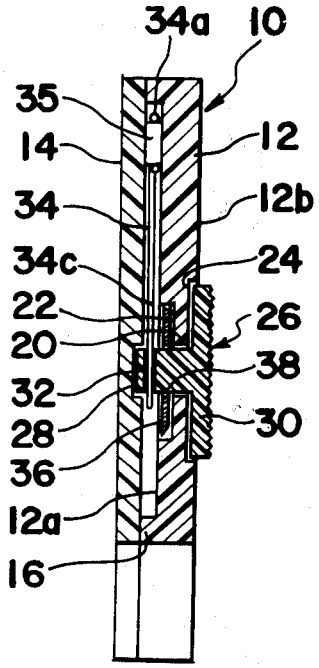
FIG. 2 is a cross-sectional view, on an enlarged scale, taken along the line II—II in FIG. 1.
Figure 3:
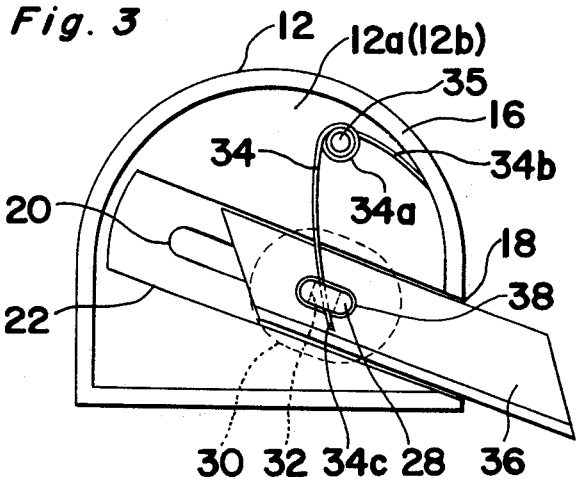
FIG. 3 is a side elevational view of one of the opposed holder segments of the knife shown in FIGS. 1 and 2, showing the manner in which a blade member is operatively carried thereby.
Figure 4:
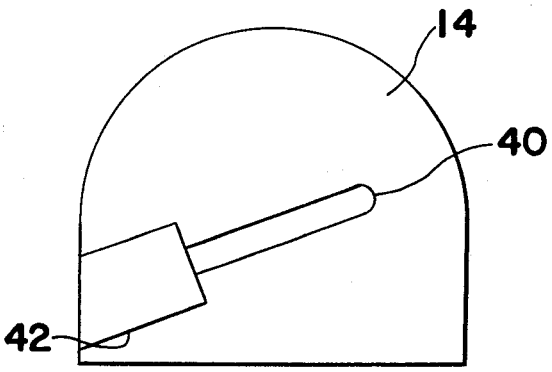
FIG. 4 is a side elevational view of the other of the opposed holder segments of the knife shown in FIGS. 1 and 2, showing the interior surface appearance thereof.

As best shown in FIGS. 2 and 3, the first holder segment 12 has a peripheral wall 16 protruding outwards therefrom in a direction at right angles to the plane of the inner surface 12*a* of the first holder segment 12 adjacent the second holder segment 14, a portion of said peripheral wall 16 being cut away at 18 to provide an opening, for example, a slot, in cooperation with the second holder segment 14 in a manner as will be described in detail later.

The first holder segment 12 also has a guide slot 20, defined therein and extending a predetermined distance in a direction towards the cut-away portion 18 in the peripheral wall 16, and a pair of like-positioned and like-oriented guideways 22 and 24 formed around the guide slot 20 and on the inner and outer surfaces 12*a* and 12*b* of the first holder segment 12, respectively, and recessed inwardly thereof. The guideways 22 and 24 so formed in the first holder segment 12 are in communication with each other through the guide slot 20 which, as illustrated, is positioned intermediately of the width of both of the guideways 22 and 24.

The handy safety knife also comprises a manipulatable element, generally identified by 26, with a construction having a generally rectangular cross-section stem 28 having on one end integrally formed with a generally disc-shaped slider 30 and a bearing aperture 32 (shown by the phantom lines in FIG. 3, but best shown in FIG. 6) defined therein at a position adjacent the other end thereof. Preferably, for a reason which will become apparent from the description concerning the operation of the handy safety knife of the present invention, the bearing aperture 32 is in the form of a slot extending completely through the stem 28.

This manipulatable element 26 is operatively carried by the first holder segment 12 with the slider 30 being positioned in the guideway 24 on the outer surface 12*b* of the first holder segment 12, and the stem 28 extending through the guide slot 20 and terminating outwardly of the guideway 22. The guide slot 20 and the stem 28 are preferably so sized and so dimensioned relative to each other as to enable the manipulatable element 26 to move smoothly between projected and retracted positions in the axial direction of and along the guide slot 20 with no possibility of rotating about the longitudinal axis of the stem 28. The length of the guide slot 20 is determinative of the stroke of movement of the manipulatable element 26 and is determined in accordance with the length of a knife blade employed as will be described later. However, the manipulatable element 26 is normally biased to the retracted position by the action of a spring element which is, as illustrated, in the form of a wire spring 34 of a type having its substantially intermediate portion coiled at 34*a*.

Referring still to FIGS. 2 and 3, the wire spring 34 is supported by the first holder segment 12 with the coiled portion 34*a* mounted on a support pin 35 integrally formed on the first holder segment 12 and protruding outwardly from the inner surface 12*a* at a position corresponding to one of the apexes of an imaginary triangle having the other two apexes substantially at the opposite ends of the guideway 22. The wire spring 34 thus supported has one end 34*b* engaged with the peripheral wall 16 and the other end 34*c* loosely inserted through the bearing aperture 32 such that the manipulatable element 26 is biased to the retracted position by the action of said wire spring 34 as hereinbefore described.

The elongated knife blade is designated by 36 and has a mounting aperture 38 defined therein, said mounting aperture 38 having a shape complementary to the cross sectional shape of the stem 28 of the manipulatable element 26 and a width substantially equal to or slightly smaller than the width of the guideway 22. This knife blade 36 is mounted on the manipulatable element 26 with the stem 28 extending through the mounting aperture 38 and is, while seated in the guideway 22, positioned between the first holder segment 12 and the end 34*c* of the wire spring 34 as best shown in FIG. 2.

The second holder segment 14 has in one surface thereof an elongated recess 40 for receiving the free end of the stem 28 and a guide block 42 protruding outwards from the second holder segment 14 a predetermined distance which may be equal to or substantially equal to the distance through which the peripheral wall 16 protrudes outwards from the first holder segment 12. This guide block 42 is, when the second holder segment 14 is joined to the first holder segment 12 in a manner as will be described later, received in the cut-away portion 18 in the peripheral wall 16 to define a slot (not shown in FIGS. 1 to 4, but identified by 44 in FIG. 8) having a width slightly larger than the thickness of the knife blade 36, through which slot 44 the knife blade 36 can move reciprocably during the movement of the manipulatable element 26 between the projected and retracted positions. It is to be noted that if the peripheral wall 16 projects from the plane of the inner surface 12*a* of the first holder segment 12 a distance equal to or slightly larger than the distance through which the free end of the stem 28 projects from the plane of the inner surface 12*a* of the first holder segment 12, the elongated recess 40 can be eliminated. However, the use of the elongated recess 40 is advantageous in that the thickness of the handy safety knife itself can be reduced.

The first and second holder segments 12 and 14 are joined together by the use of a suitable bonding agent. However, in order to minimize the number of manufacturing steps, the use of a pin-and-socket arrangement is preferred. This pin-and-socket arrangement comprises, although not shown in FIGS. 1 to 6, but shown in FIG. 7, one or more pins 46 formed on the inner surface of one of the respective first and second holder segments 12 and 14, for example, the inner surface of the first holder segment 12, and a corresponding number of sockets 48 formed on the other of the inner surface of the other of the respective first and second holder segments 12 and 14, that is, the inner surface of the second holder segment 14. The pin-and-socket arrangement is so designed that, when the first and second holder segments 12 and 14 are joined to each other with the guide block 42 received in the cut-away portion 18 in the peripheral wall 16, the pins 46 are tightly inserted into the respective sockets 48. It is to be noted that the pin-and-socket arrangement may be employed concurrently with the use of the suitable bonding agent.

The handy safety knife constructed in the manner described above can be used in the following manner. When and so long as the manipulatable element 26 is held in the retracted position by the action of the wire spring 34, the knife blade 36 is entirely concealed within the holder 10. When the tip of the knife blade 36 facing towards the slot 44 (FIG. 8) is desired to be projected out of the holder 10 in readiness for the actual use of the handy safety knife in, for example, paper cutting, it is necessary to apply an external pushing force to the slider 30 in a direction opposite to the direction in which the biasing force of the wire spring 34 tends to urge the manipulatable element 26 towards the retracted position.

Figure 8:
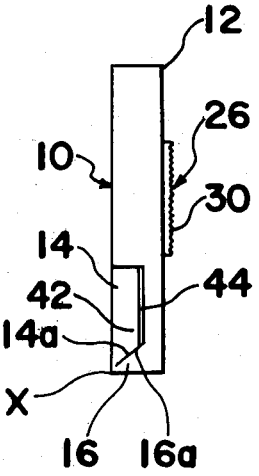
FIG. 8 is an end elevational view of the handy safety knife shown in FIG. 7.

As such an external force is applied to the slider 30, the manipulatable element 26 moves against the force exerted by the wire spring 34 in a direction towards the projected position, accompanied by a corresponding sliding movement of the knife blade 36 with the tip of the knife blade 36 gradually protruding out of the holder 10 through the slot 44 (FIG. 8). FIGS. 1 and 2 show the condition in which the manipulatable element 26 is moved to the projected position.

Subsequent release of the external pushing force from the slider 30 results in automatic return of the manipulatable element 26 back to the retracted position with the knife blade 36 concealed within the holder 10.

It is to be noted that because of the bearing aperture 32 in the stem 28 which is in the form of a slot, the end 34*c* of the wire spring 34 will undergo motion within the bearing aperture 32 without the possibility of the end 34*c* of the wire spring 34 being bent. Although the handy safety knife according to the present invention can operate satisfactorily even if the bearing aperture 32 is in the form of a circular cross-section hole of a diameter substantially equal to the diameter of the wire spring 34, this would involve the possibility that, particularly during the movement of the manipulatable element 26 from the retracted position towards the projected position, the end 34*c* of the wire spring 34 would tend to be bent while axially moving through the bearing aperture 32 and, therefore, a gradually increased external pushing force would be required to move the manipulatable element 26 towards the projected position.

It is also to be noted that the use of the wire spring 34 of a type having its intermediate portion 34*a* coiled is advantageous in that when manipulatable element 26 is moved to the projected position as shown in FIGS. 1 and 3 with the tip of the knife blade 36 exposed outside the holder 10 through the slot 44 (FIG. 8) in readiness for the actual use of the handy safety knife in, for example, paper cutting, a portion of the knife blade 36 adjacent the exposed tip thereof and situated within the slot 44 is shifted upwardly as viewed in FIG. 3 substantially pivoting about the stem 28 of the manipulatable element 26. This is possible because the end 34*c* of the wire spring 34, when moved in a direction towards the end 34*b* of the wire spring 34 incident to the movement of the manipulatable element 26 to the projected position, acts to depress the portion of the stem 28 on the trailing side with respect to the direction of movement of the manipulatable element 26 towards the projected position, thus tending to rotate the manipulatable element 26 counterclockwise, as viewed in FIG. 3, about the longitudinal axis of the stem 28. Therefore, there is no possibility of the knife edge of the knife blade 36 contacting the adjacent portion of the peripheral wall 16 when the manipulatable element 26 is in the projected position. In addition, the use of the wire spring 34 of the type referred to above has the additional advantage that the knife blade 36 can be forced to contact the inner surface 12*a* of the first holder segment 12 lightly by the action of the end 34*b* of the wire spring 34 because of the coiled portion 34*a* acts in a manner similar to a tension spring.

According to the first preferred embodiment of the present invention which has been described with reference to FIGS. 1 to 4, the continued application of the external pushing force to the slider 30 is required during the actual use of the handy safety knife. Accordingly, when the handy safety knife held in one of the hands of a user is shifted to the other hand for some reason, the knife blade 36 is automatically concealed within the holder 10 by the action of the wire spring 34 and, therefore, the external pushing force must be again applied to the slider 30 to project the knife blade 36 out of the holder 10. This may be inconvenient and, in order to avoid this, the handy safety knife according to the present invention may have means for retaining the manipulatable element 26 in the projected position once it has been moved thereto and unless an external release force is applied, which will now be described with particular reference to FIGS. 5 and 6.

Figure 5:
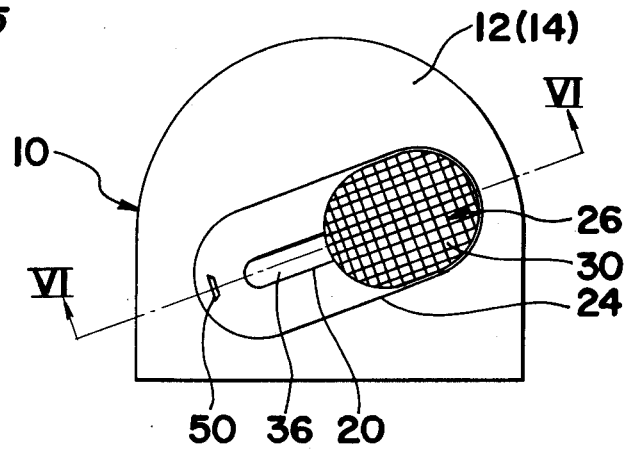
FIG. 5 is a view similar to FIG. 1, showing another preferred embodiment of the present invention.
Figure 6:
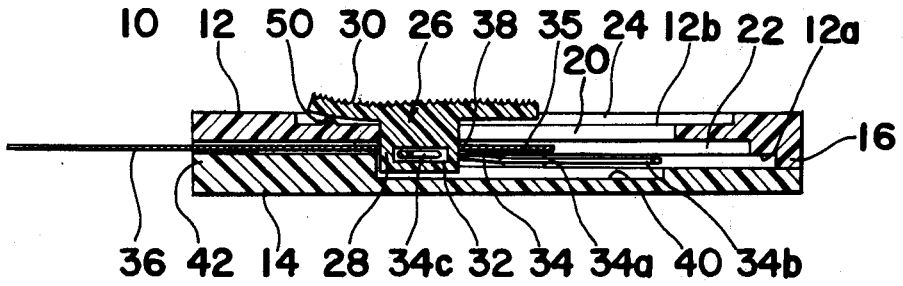
FIG. 6 is a cross-sectional view, on an enlarged scale, taken along the line VI—VI in FIG. 5.

Referring now to FIGS. 5 and 6, the means for retaining the manipulatable element 26 in the projected position comprises a wedge 50 in the form of a projection formed on the outer surface 12*b* of the first holder segment 12 and inside the guideway 24 and projecting a slight distance from the first holder segment 12. This wedge 50 is so positioned that when the manipulatable element 26 is moved to the projected position, the slider 30 slides over the wedge 50 and a portion of the slider 30 is elastically deformed outwards in a direction away from the first holder segment 12 due to the contact with the tip of the wedge 50 as best shown in FIG. 6. This can be accomplished by employing a synthetic resin, for example, polyethylene, polypropylene or polyvinyl chloride, as a material for at least the manipulatable element 26. Alternatively, all of the components of the handy safety knife except for the knife blade 36 may be made of a synthetic resin.

The manipulatable element 26 retained in the projected position due to the slider 30 riding over the wedge 50 and friction developed between the slider 30 and the wedge 50 in an amount sufficient to overcome the biasing force of the wire spring 34, can be caused to return automatically to the retracted position by the action of the wire spring 34 when a slight external pushing force is applied to the slider 30 to move the latter in a direction towards the retracted position.

Although in the embodiment shown in FIGS. 5 and 6 the wedge 50 has been described as positioned to enable the slider 30 to ride over it when the manipulatable element 26 is moved to the projected position, it may be positioned on a peripheral wall defining the guideway 24 so that when the manipulatable element 26 is moved to the projected position, the wedge 50 will be in the clearance between the perimeter of the slider 30 and the wall defining the guideway 24.

In either case, the slider 30 may have a detent recess adapted to receive the wedge 50 therein when the manipulatable element 26 is moved to the projected position.

In any one of the foregoing embodiments of the present invention shown respectively in FIGS. 1 to 4 and FIGS. 5 and 6, the first and second holder segments 12 and 14 are separately manufactured by the utilization of any known plastic molding technique, for example, either an extrusion molding method or an injection molding method. This means that the use of separate molds for the respective holder segments 12 and 14 is required, involving a relatively high manufacturing cost. However, the holder having the construction shown in FIGS. 7 and 8 does not require the use of separate molds and, therefore, can readily be manufactured without an increased manufacturing cost.

Figure 7:
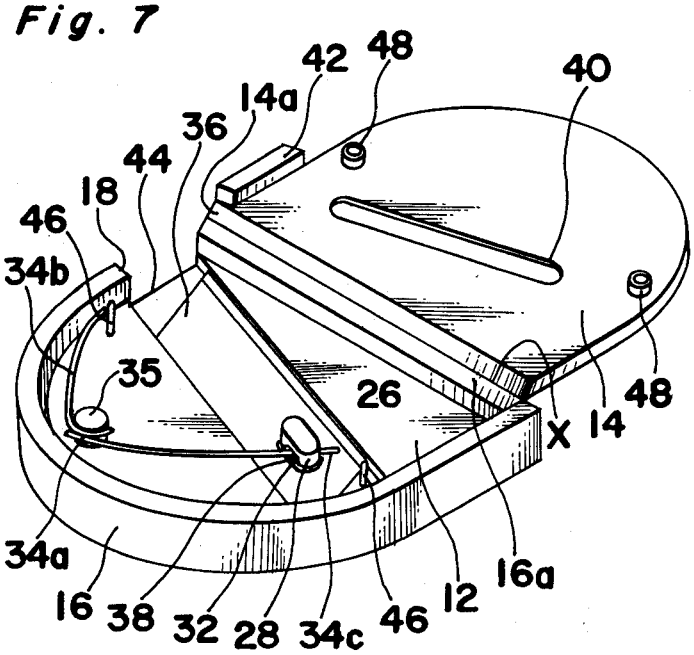
FIG. 7 is a perspective view of the handy safety knife according to a third preferred embodiment of the present invention.

Referring now to FIGS. 7 and 8, the first holder segment 12, including the peripheral wall 16, and the second holder segment 14 including the guide block 42 have a one-piece construction. Specifically, the first and second holder segments 12 and 14 are integrally connected with each other by a huge portion and are foldable together in a manner similar to butterfly wings. More specifically, one side edge of a portion of the peripheral wall 16 opposite the first holder segment 12 is integrally formed with the second holder segment 14 so as to be pivotable about a hinge axis identified by X, and the second holder segment 14 is so sized as to be received inside the peripheral wall 16 of the first holder segment 12.

The axis X is so positioned as to enable the pins 46 to be tightly received in the corresponding sockets 48 when the first and second holder segments 12 and 14 are folded together, and the portion of the peripheral wall 16 and a portion of the second holder segment 14 adjacent that portion of the peripheral wall 16 are so chamfered at 14*a* and 16*a*, respectively, in complementary relation to each other that when the first and second holder segments 12 and 14 are folded together, the plane of the outer surface of the second holder segment 14 will lie at right angles to the plane of the outer peripheral face of the peripheral wall 16 as best shown in FIG. 8.

From the foregoing, it will readily be seen that the handy safety knife according to the embodiment shown in FIGS. 7 and 8 will operate in a manner similar to the operation of the embodiment shown in FIGS. 1 to 4.

In any event, the handy safety knife according to any one of the foregoing embodiments can readily be assembled without requiring the use of any tool such as jig. Specifically, once the first holder segment 12, the manipulatable element 26, the knife blade 36 and the wire spring 34 have been assembled in the manner as hereinbefore described, there is no possibility of separation of these component parts from each other even if the assembly of these component parts is placed on a surface such as a table with either one of the inner and outer surfaces 12*a* and 12*b* of the first holder segment 12 oriented downwards. In other words, once the component parts 12, 26, 34 and 36 have been assembled, the wire spring 34 retains the other component parts in position. Therefore, the assemblege of the complete handy safety knife according to the present invention does not require the attendance of skilled workers and can be done at a reasonably reduced cost.

Although the present invention has fully been described in connection with the preferred embodiments thereof with reference to the accompanying drawings, it is to be noted that various changes and modifications will be apparent to those skilled in the art. By way of example, the peripheral wall 16 which has been described as formed on the first holder segment 12 may be formed on the second holder segment 14 and, in this case, the use of the guide block 42 can be eliminated. In addition, both of the guideways, 22 and 24 may not always be necessary if the stem 28 has a sufficient size to avoid the rotation of the manipulatable element 26 about the longitudinal axis of the stem 28 on one hand and, on the other hand, the retracted position of the manipulatable element 26 is so selected that when the manipulatable element 26 is held in the retracted position, the tip of the knife blade 36 adjacent the slot 44 is positioned intermediately of the thickness of the peripheral wall 16.

Moreover, although the elongated knife blade 36 has been shown as having a knife edge extending along one side thereof, it may have a knife edge at one end portion thereof adjacent the slot 44.

Furthermore, since the external pushing force is applied to the slider 30 during the use of the handy safety knife of the present invention by a finger of the user, the surface area of the slider 30 opposite to the stem 28 may have a plurality of indentations, such as shown, to avoid any possible slippage of the user's finger relative to the slider 30.

In addition, at least one of the first and second holder segments 12 and 14, preferably the second holder segment 14, may be made of a synthetic resin containing a magnetic powder distributed therein so that the handy safety knife of the present invention can be used not only as a knife itself but also a magnet paper holder for holding paper or the like sheet material to a magnetizable wall by the utilization of a magnetic attraction force.

Accordingly, such changes and modifications are to be understood as being included within the true scope of the present invention unless they depart therefrom.

What is claimed is:

1. A compact safety knife which comprises:

a generally flat holder having a chamber therein and an opening therein opening out of said chamber;

an elongated blade member in said chamber;

said holder having a guide slot defined therein;

a manipulatable member mounted on said holder and having a slider positioned externally of the holder and a stem having one end integrally formed with said slider and extending through said guide slot, and said stem having a slot therein, said manipulatable member being movable between projected and retracted positions for, when said manipulatable member is moved to the projected position, moving said blade member through said opening a distance such that only one end portion of the blade member projects out of the chamber through the opening, and when said manipulatable member is moved to the retracted position, said blade member is moved so that it is completely within said chamber; said guide slot extending in a direction parallel to the direction of movement of the blade member;

means in said holder for guiding the blade member for straight movement in the longitudinal direction thereof during the movement of the manipulatable member between the projected and retracted positions; and a wire spring in said chamber having one end engaged with said holder, the other end of said wire spring loosely extending through said slot in said stem and biasing said manipulatable member to the retracted position and when the manipulatable member is in the projected position tending to move the blade member in a direction so that the cutting edge thereof is spaced from the edge of said opening in said holder.

2. A knife as claimed in claim 1 in which said stem further extends through said blade member and said stem slot is on the opposite side of said blade member, whereby the other end of said wire spring holds said blade on said stem.

3. A knife as claimed in claim 1 wherein said holder is constituted by substantially plate-like first and second holder segments in face-to-face relation with each other with said chamber defined therebetween, said segments being separate and having interengaging means holding them together.

4. A knife as claimed in claim 1 wherein said holder is constituted by first and second substantially plate-like holder segments integrally formed with each other and having a hinge portion about which said segments are folded together to form the complete holder.

5. A compact safety knife which comprises:

a generally flat holder having a chamber therein and an opening therein opening out of said chamber;

an elongated blade member in said chamber;

a manipulatable member mounted on said holder for movement between projected and retracted positions and having the blade member operatively coupled thereto for, when said manipulatable member is moved to the projected position, moving said blade member through said opening a distance such that only one end portion of the blade member projects out of the chamber through the opening, and when said manipulative member is moved to the retracted position, said blade member is moved so that it is completely within said chamber;

means in said holder for guiding the blade member for straight movement in the longitudinal direction thereof during the movement of the manipulatable member between the projected and retracted positions;

said holder having a spring mounting projection projecting into said chamber;

a wire spring in said chamber having one end engaged with said holder, an intermediate portion of said wire spring being coiled and mounted on said mounting projection, the other end of said wire spring loosely engaged with said manipulatable member and biasing said manipulatable member to the retracted position and when the manipulatable member is in the projected position tending to move the blade member in a direction so that the cutting edge thereof is spaced from the edge of said opening in said holder.

6. A compact safety knife which comprises:

a generally flat holder having a chamber therein and an opening therein opening out of said chamber;

an elongated blade member in said chamber;

a manipulatable member mounted on said holder for movement between projected and retracted positions and having the blade member operatively coupled thereto for, when said manipulatable member is moved to the projected position, moving said blade member through said opening a distance such that only one end portion of the blade member projects out of the chamber through the opening, and when said manipulatable member is moved to the retracted position, said blade member is moved so that it is completely within said chamber;

means in said holder for guiding the blade member for straight movement in the longitudinal direction thereof during the movement of the manipulatable member between the projected and retracted positions;

a wire spring in said chamber having one end engaged with said holder, the other end of said wire spring loosely engaged with said manipulatable member and biasing said manipulatable member to the retracted position and when the manipulatable member is in the projected position tending to move the blade member in a direction so that the cutting edge thereof is spaced from the edge of said opening in said holder; and a projection on said holder frictionally engaged by said manipulatable member when said manipulatable member is moved to said projected position for retaining the manipulatable member in the projected position once it has been moved thereto.

* * * * *